US007966938B2

(12) United States Patent
Theurer et al.

(10) Patent No.: US 7,966,938 B2
(45) Date of Patent: Jun. 28, 2011

(54) MACHINE FOR PICKING UP AND STORING RAIL FASTENINGS OF A TRACK, AND A METHOD

(75) Inventors: Josef Theurer, Vienna (AT); Manfred Brunninger, Altenberg (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 12/451,450

(22) PCT Filed: May 3, 2008

(86) PCT No.: PCT/EP2008/003572

§ 371 (c)(1),
(2), (4) Date: Nov. 12, 2009

(87) PCT Pub. No.: WO2008/154986

PCT Pub. Date: Dec. 24, 2008

(65) Prior Publication Data

US 2010/0132582 A1 Jun. 3, 2010

(30) Foreign Application Priority Data

Jun. 19, 2007 (AT) ..... A 947/2007

(51) Int. Cl.
*E01B 29/05* (2006.01)

(52) U.S. Cl. ..... 104/2; 104/3; 104/4; 104/7.1; 104/9

(58) Field of Classification Search ..... 104/2, 3, 104/4, 5, 6, 7.1, 8, 9
See application file for complete search history.

(56) References Cited

U.S. PATENT DOCUMENTS

| | | | | |
|---|---|---|---|---|
| 4,225,429 | A * | 9/1980 | Holley | 209/215 |
| 4,241,663 | A * | 12/1980 | Lund et al. | 104/16 |
| 4,301,738 | A * | 11/1981 | Theurer | 104/2 |
| 4,393,784 | A * | 7/1983 | Theurer | 104/2 |
| 5,546,864 | A * | 8/1996 | Straub et al. | 104/17.2 |
| 5,577,447 | A * | 11/1996 | Weber et al. | 104/2 |
| 5,586,502 | A * | 12/1996 | Weber | 104/17.2 |
| 5,671,679 | A * | 9/1997 | Straub et al. | 104/2 |
| 5,778,794 | A * | 7/1998 | Theurer et al. | 104/2 |
| 2001/0050023 | A1* | 12/2001 | Theurer et al. | 104/2 |
| 2002/0148378 | A1* | 10/2002 | Theurer | 104/2 |

(Continued)

FOREIGN PATENT DOCUMENTS

| | | |
|---|---|---|
| DE | 29 30 682 | 7/1980 |

(Continued)

OTHER PUBLICATIONS

International Search Report.

*Primary Examiner* — S. Joseph Morano
*Assistant Examiner* — Jason C Smith
(74) *Attorney, Agent, or Firm* — Collard & Roe, P.C.

(57) ABSTRACT

A machine (1) for picking up and storing rail fastenings (2) of a track (3) includes two rail fastening pickup devices (9). Arranged between these and a rear on-track undercarriage (4)—with regard to a working direction (6)—is a crawler track (24). At each longitudinal side of the machine, two devices (29) for guiding rails (30) are provided which are adjustable by drives (28) relative to the machine frame (5) and arranged one following the other in the longitudinal direction of the machine.

6 Claims, 2 Drawing Sheets

U.S. PATENT DOCUMENTS

Figure 1:
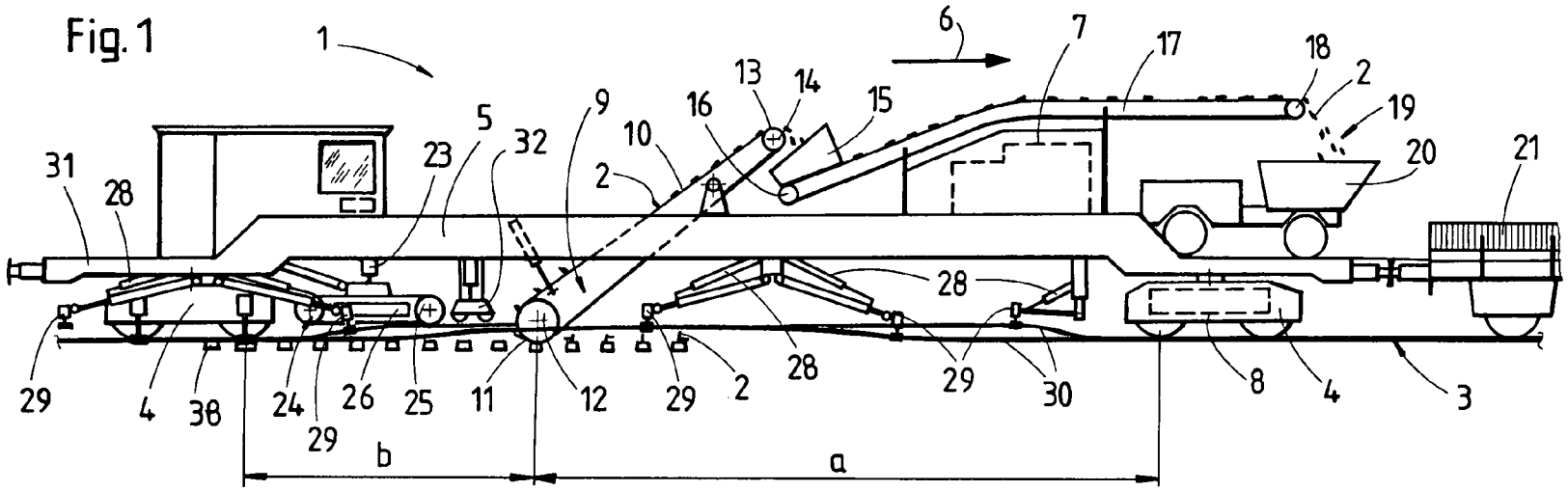

| | | | | |
|---|---|---|---|---|
| 2003/0037695 | A1* | 2/2003 | Theurer et al. | 104/7.1 |
| 2004/0003748 | A1* | 1/2004 | Theurer et al. | 104/2 |
| 2004/0045472 | A1* | 3/2004 | Therurer et al. | 104/2 |
| 2006/0045684 | A1* | 3/2006 | Sperling | 414/434 |
| 2006/0219123 | A1* | 10/2006 | Theurer | 104/2 |
| 2007/0022898 | A1* | 2/2007 | Theurer et al. | 104/2 |
| 2007/0157844 | A1* | 7/2007 | Barezzani et al. | 104/2 |
| 2007/0245921 | A1* | 10/2007 | Haughey | 104/2 |
| 2008/0035009 | A1* | 2/2008 | Ganz | 104/2 |
| 2008/0163780 | A1* | 7/2008 | Theurer et al. | 104/2 |
| 2009/0133598 | A1* | 5/2009 | Coots, Jr. | 104/2 |
| 2010/0132582 | A1* | 6/2010 | Theurer et al. | 104/2 |

FOREIGN PATENT DOCUMENTS

| | | |
|---|---|---|
| EP | 1 127 980 | 8/2001 |
| EP | 1 502 993 | 2/2005 |
| GB | 1 574 203 | 9/1980 |

* cited by examiner

MACHINE FOR PICKING UP AND STORING RAIL FASTENINGS OF A TRACK, AND A METHOD

CROSS REFERENCE TO RELATED APPLICATIONS .

This application is the National Stage of PCT/EP2008/003572 filed on May 3, 2008, which claims priority under 35 U.S.C. §119 of Austrian Application No. A 947/2007 filed on June 19, 2007. The international application under PCT article 21(2) was not published in English.

The invention relates to a machine for picking up and storing rail fastenings of a track and to a method of renewing a track.

A machine of this type is known from U.S. Pat. No. 4,225,429. With the aid of a crawler track arranged between on-track undercarriages positioned at the ends, the machine is mobile on ribbed sole-plates of the track.

According to U.S. Pat. No. 4,241,663 it is known to lift the rail fastenings from the old sleepers in connection with a track renewal. Since, in addition to this transport of materials, the old and new sleepers also still must be conveyed, capacity limits may be reached rather quickly.

It is the object of the present invention to provide a machine or method of the specified type with which it is possible to transport also larger amounts of rail fastenings without problems.

According to the invention, this object is achieved with a machine of the specified type by means according to the invention or with a method according to the invention.

Due to being designed in this manner, the machine can be employed in an advantageous way in connection with a preliminary stage for sleeper exchange in which the old rails are lifted from the sleepers for the purpose of introducing new rails. By being spatially separated from a trailing machine for the track renewal, the machine according to the application can be adapted for particularly high transport performance for rail fastenings. Parallel thereto, it is furthermore possible with the lowered crawler track to advance the preliminary operations for the subsequent sleeper exchange to such an extent that, with the aid of the devices for guiding the rails, the new rails can be passed on to the following machine in the raised position already.

Additional advantages of the invention become apparent from the specification and the drawing description.

Figure 2:
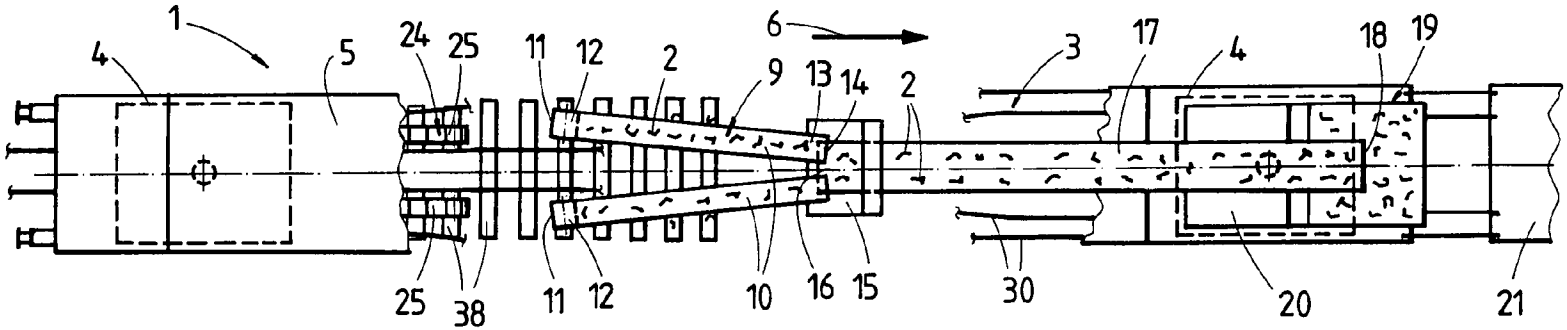

The invention will be described in more detail below with reference to an embodiment represented in the drawing in which FIG. 1 shows a side view of a machine for picking up rail fastenings, FIG. 2 shows a simplified top view of the machine, FIGS. 3 and 4 each show a side view of the machine in combination with a track renewal train.

As can be seen in FIGS. 1 and 2, a machine 1 for picking up rail fastenings 2 of a track 3 has a machine frame 5 mobile on on-track undercarriages 4. An energy center 7 with a motive drive 8 is provided for the operational forward travel in a working direction 6.

Located between the on-track undercarriages 4 is a rail fastening pickup device 9. This is composed of two conveyor belts 10, each comprising at a lower deflection end 11 a rotatable magnetic drum 12 and, formed by an upper deflection end 13, a discharge end 14. The discharge ends 14 are situated above the machine frame 5, or above a hopper 15 which is positioned at a receiving end 16 of a conveyor belt 17 extending in the longitudinal direction of the machine. The latter has a discharge end 18 situated above the front on-track undercarriage 4 with regard to the working direction 6.

Provided underneath the discharge end 18 is a receiving station 19 for transfer of the rail fastenings 2 from the conveyor belt 17 to a transport vehicle 20 which is mobile on an attached wagon 21 in the longitudinal direction of the machine.

Arranged between the rail fastening pickup device 9 and the rear on-track undercarriage 4—with regard to the working direction 6—is a crawler track 24 vertically adjustable by drives 23. The crawler track 24 comprises two undercarriage parts 25, spaced from one another in the transverse direction of the machine, each of which is equipped with a motive drive 26.

Between the lower deflection end 11 of the rail fastening pickup device 9 and the front on-track undercarriage 4, three devices 29 for guiding rails 30 are provided per longitudinal side of the machine, the devices 29 being adjustable by drives 28 relative to the machine frame 5 and arranged one following the other in the longitudinal direction of the machine. Additionally, devices 29 are also provided at a rear machine end 31.

A distance a between the front on-track undercarriage 4 and the lower deflection end 11 of the rail fastening pickup device 9 is greater by at least 50% than a distance b delimited by the lower deflection end 11 and the rear on-track undercarriage 4. A vertically adjustable auxiliary on-track undercarriage 32 is arranged between the lower deflection end 11 of the rail fastening pickup device 9 and the crawler track 24.

Figure 3:
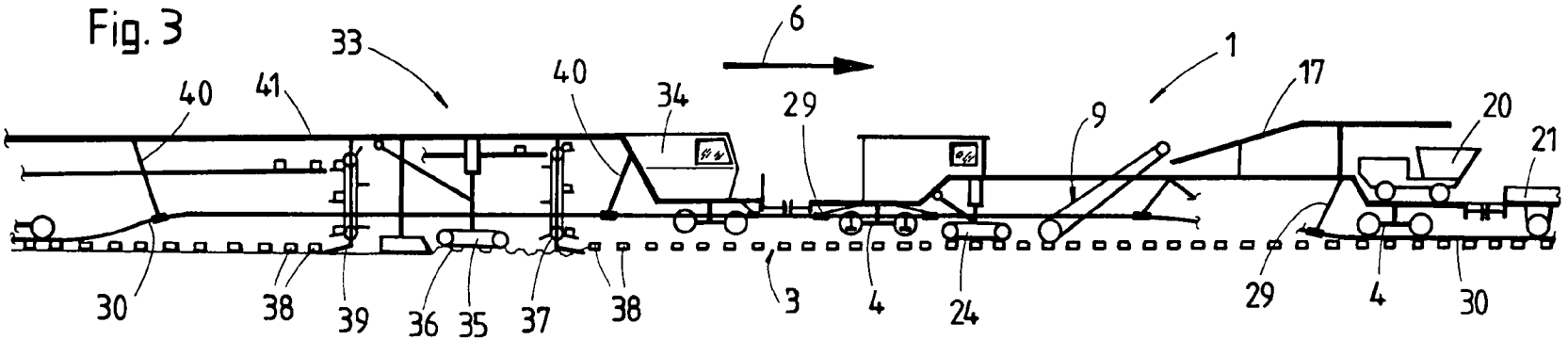
Figure 4:
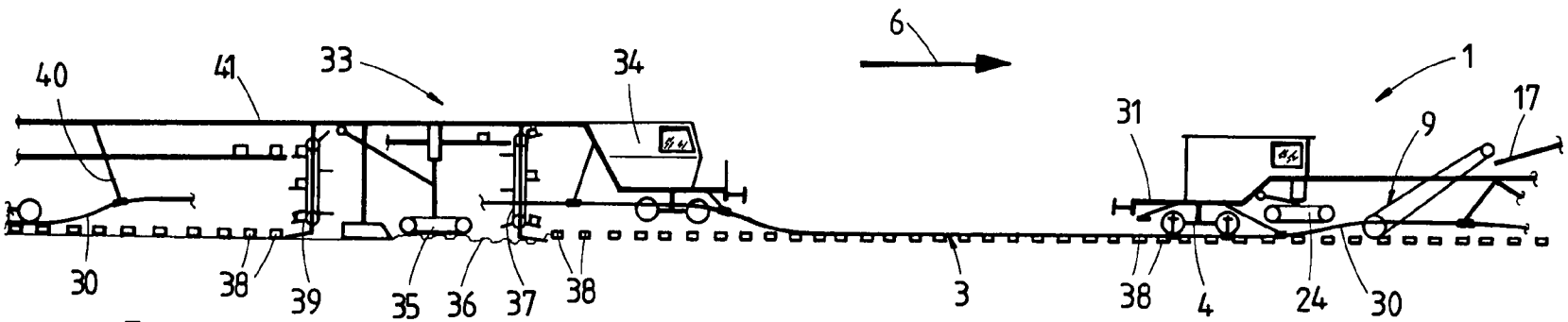

As visible in FIGS. 3 and 4, a track renewal train 33 is provided behind the machine 1, said train having a front machine end 34 mobile by means of a crawler track 35 on a ballast bed 36. A device 37 for taking up old sleepers 38 is situated in front of the crawler track 35. New sleepers 38 are laid by means of a device 39 following behind in the working direction 6. For the purpose of guiding the new rails 30, adjustable devices 40 are connected to a machine frame 41.

In working operations, the machine 1 is moved continuously in the indicated working direction 6, during which the old rails 30 are lifted from the sleepers 38 by the devices 29 and laid down in the middle on the track 3. The rail fastenings 2, including the exposed ribbed sole-plates, are lifted by the two magnetic drums 12 and discharged via the conveyor belt 17 upon the transport vehicle 20. After being filled, the latter is driven onto the attached wagons 21 in order to unload the rail fastenings 2. The quantity of accumulating rail fastenings 2 is dependent upon the track type and may add up to about eight tons per kilometre.

The two undercarriage parts 25 of the crawler track 24 are riding on the old sleepers 38, namely on those portions on which the ribbed sole-plates were laying previously (see FIG. 3). With the aid of the rear devices 29, the new rails 30 are lifted and transferred to the trailing devices 40 of the track renewal train 33 coupled to the machine 1. Said track renewal train 33 travels on the ballast bed 36 by means of the crawler track 35, after the old sleepers 38 have been removed beforehand. Subsequently, the new sleepers 38 are laid down, and the new rails 30 upon these.

In an alternative method represented in FIG. 4, after removal of the rail fastenings 2, the old rails 30 are laid provisionally upon the old sleepers 38, with the rear machine end 31 being supported by means of the rear on-track undercarriage 4 on the old rails 30. These are then lifted by the following track renewal train 33 and replaced with the new rails 30.

Alternatively, however, the new rails 30 can also be laid provisionally upon the old sleepers 38 in front of the said rear on-track undercarriage 4 of the rear machine end 31 already. The new rails 30 are then spread apart for the sleeper renewal and subsequently laid upon the new sleepers 38.

The invention claimed is:

1. A machine for picking up and storing rail fastenings of a track, including a machine frame having a front on-track undercarriage and a rear on-track undercarriage, a vertically adjustable crawler track arranged between the front on-track undercarriage and the rear on-track undercarriage, and a rail fastening pickup device, wherein:

a) the rail fastening pickup device comprises two conveyor belts, each conveyor belt having a rotatable magnetic drum at a lower deflection end and a discharge end, formed by an upper deflection end positioned above the machine frame, b) the crawler track is arranged between the rail fastening pickup device and the rear on-track undercarriage with regard to a working direction, c) between the lower deflection end of the rail fastening pickup device and the front on-track undercarriage, at least two devices for guiding rails are provided per longitudinal side of the machine, the devices being adjustable by drives relative to the machine frame and arranged one following the other in the longitudinal direction of the machine.

2. A machine according to claim 1, wherein at least two devices for guiding rails are provided per longitudinal side of the machine at a rear machine end, the devices being adjustable by drives relative to the machine frame and arranged one following the other in the longitudinal direction of the machine.

3. A machine according to claim 1, wherein a distance a between the front on-track undercarriage and the lower deflection end of the rail fastening pickup device is greater by at least 50% than a distance b delimited by the lower deflection end and the rear on-track undercarriage.

4. A machine according to claim 1, wherein a vertically adjustable auxiliary on-track undercarriage is arranged between the lower deflection end of the rail fastening pickup device and the crawler track.

5. A machine according to claim 1, wherein a conveyor belt, adjoining the discharge ends of the two conveyor belts of the rail fastening pickup device and extending in the longitudinal direction of the machine, is provided whose discharge end is provided above the front on-track undercarriage.

6. A machine according to claim 5, wherein provided underneath the discharge end is a receiving station for transfer of the rail fastenings from the conveyor belt to a transport vehicle mobile on an attached wagon in the longitudinal direction of the machine.

* * * * *